US005386356A

United States Patent [19]

Davis, Jr. et al.

[11] Patent Number: 5,386,356

[45] Date of Patent: Jan. 31, 1995

[54] WEATHERPROOF ELECTRIC LIGHTING FIXTURE

[76] Inventors: Zell Davis, Jr., 3001 Lake Dr., Singer Island, Fla. 33404; David J. McSorley, 22 Dorchester Cir., Palm Beach Gardens, Fla. 33418

[21] Appl. No.: 44,698

[22] Filed: Apr. 12, 1993

[51] Int. Cl.[6] ..... F21V 31/02

[52] U.S. Cl. ..... 362/267; 362/226; 362/431; 439/277

[58] Field of Search ..... 362/256, 267, 306, 382, 362/431, 226, 437; 439/271, 277, 280, 548, 549, 567

[56] References Cited

U.S. PATENT DOCUMENTS

| | | | |
|---|---|---|---|
| 382,110 | 5/1888 | Reilly . | |
| 503,349 | 8/1893 | Lee . | |
| 1,575,548 | 3/1926 | Cuno | 362/306 |
| 1,724,592 | 8/1929 | Hudson | 439/280 |
| 1,911,612 | 5/1933 | Eckstein et al. . | |
| 2,015,590 | 9/1935 | Cavanagh et al. | 439/280 |
| 2,119,452 | 5/1938 | Woodhead | 173/358 |
| 2,123,483 | 7/1938 | Langille | 362/306 |
| 2,151,882 | 3/1939 | Woodhead | 439/271 |
| 2,797,310 | 6/1957 | Moore | 362/431 |
| 3,049,613 | 8/1962 | Baldwin | 362/267 |
| 3,101,984 | 8/1963 | Wieckmann | 339/69 |
| 3,433,967 | 3/1969 | Bernheim | 439/280 |
| 3,564,231 | 2/1971 | Bruce | 362/32 |
| 4,283,597 | 8/1981 | Cooper, Jr. | 439/271 |
| 4,660,916 | 4/1987 | Williams, Jr. | 339/94 |

FOREIGN PATENT DOCUMENTS

| | | | |
|---|---|---|---|
| 424892 | 5/1991 | European Pat. Off. | 439/277 |
| 1207463 | 12/1965 | Germany | 439/277 |
| 0566015 | 8/1957 | Italy | 439/277 |
| 0021328 | of 1902 | United Kingdom | 439/277 |
| 1261375 | 1/1972 | United Kingdom | 362/306 |
| 1422112 | 1/1976 | United Kingdom | 362/306 |

*Primary Examiner*—Ira S. Lazarus
*Assistant Examiner*—Y. Quach
*Attorney, Agent, or Firm*—Eugene D. Farley

[57] ABSTRACT

A weatherproof electric lamp fixture adaptable particularly for use outdoors or in high humidity or corrosive environments. The fixture comprises an electric lampholder with cord and a tubular sheath fitting snugly about the lampholder and cord. Seals are provided at the joints between the lamp and the sheath, and the cord and the sheath. Means is provided for mounting the fixture on a stake which may be driven in the ground at a desired location. Also provided are sealed shroud means which enclose and protect the lamp.

3 Claims, 1 Drawing Sheet

WEATHERPROOF ELECTRIC LIGHTING FIXTURE

This invention relates to weatherproof electric lighting fixtures.

BACKGROUND AND GENERAL STATEMENT OF THE INVENTION

Weatherproof electric lighting fixtures are widely used in circumstances where the fixtures are subjected during use to the deteriorating influences of rain, moisture, snow, wind, and corrosive gases. These factors are of importance in such applications as the outdoor lighting of industrial areas, lawns and patios. They also have interest in connection with certain indoor applications, as for example in environments where the lighting fixtures are subjected to the degrading influence of steam, high humidity, or corrosive chemical vapors. They have further application in mines, on ships, and in marine installations.

Of particular interest is their application in outdoor situations in which a multiplicity of fixtures are mounted on stakes driven into the ground in a given area for ornamental or utilitarian purposes. It is with reference to this application that the present invention is described, although no limitation thereby is intended.

It is the general purpose of the present invention to provide a weatherproof electric lighting fixture of general application, particularly in salt water environments, which effectively protects over a long service life the electric lamp with which it is associated.

It is another important object of the present invention to provide such a fixture which is adaptable for use with an ordinary incandescent light bulb, as opposed to a sealed beam floodlight lamp, thereby achieving the same degree of light intensity at one-quarter or one-fifth the cost.

Still a further object of the present invention is the provision of such a fixture which is adaptable for use with a diversity of mounting appliances, including stakes or spikes adapted to be driven in the ground, wires adapted to be strung overhead, brackets adapted to be mounted on walls or ceilings, and the like.

Yet another object of the invention is the provision of such a fixture of relatively simple, inexpensive construction, without any external nuts, bolts, or screws, which provides for the facile interchange of electric light bulbs; and which provides also for the interchange of component lenses of varying color as desired to achieve interesting lighting effects.

Generally stated, the weatherproof electric lighting fixture of the invention which achieves the foregoing and other objects comprises an electric lamp holder including an open end adapted to receive an electric lamp and an opposite end including an electric cord. A tubular lamp holder sheath made of water resistant material is contoured and dimensioned to fit snugly around the lamp holder.

The sheath has an open outer end and an open inner end. It also has a stepped configuration providing an outer segment forming a chamber of enlarged cross section for reception of the lamp holder as well as a connecting tube segment of restricted cross section for reception of the cord, both in sealed relationship.

An outwardly flared tubular shroud of water-resistant material having an outer end of enlarged diameter and an open inner end of restricted diameter is mounted on the lamp holder by telescopic engagement. Within the shroud a light-reflective liner lends stability and light reflection characteristics to the assembly. A lens of selected color is mounted across the open outer end of the shroud. It too is sealed against entrance of moisture.

THE DRAWINGS

DETAILED DESCRIPTION OF A PREFERRED EMBODIMENT OF THE INVENTION

Figure 1:
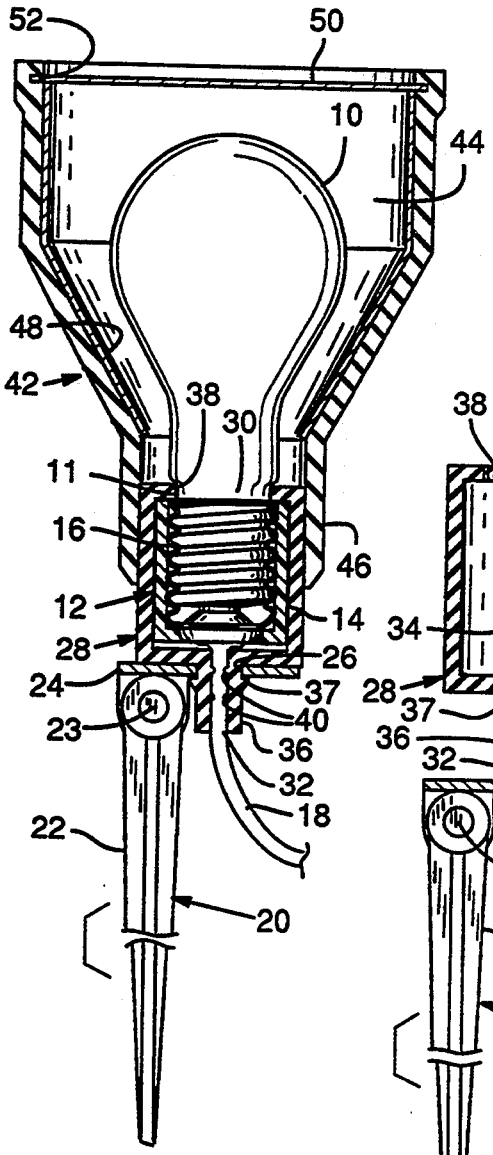
FIG. 1 is a vertical sectional view of the weatherproof electric lighting fixture of the invention, illustrated in working position on a mounting stake.
Figure 2:
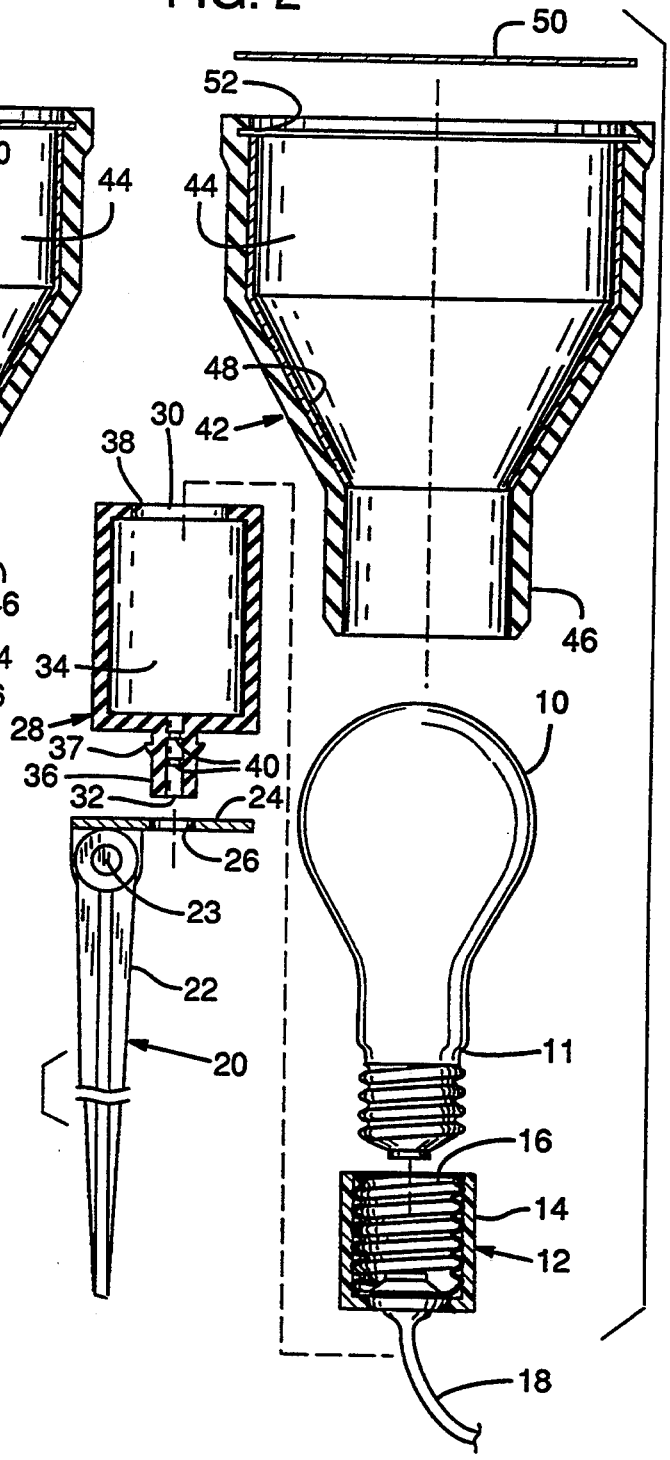
FIG. 2 is an exploded view in vertical section illustrating the component parts of the fixture in their relationship to each other.

The presently described weatherproof electric lighting fixture is adapted for use with a conventional electric light bulb 10 provided with the usual chamfered annular shoulder 11. The light bulb is designed for reception in a conventional lamp holder 12 including a rigid, cylindrical, plastic case 14, a conductive metal socket 16 into which the lamp is adapted to be threaded, and an electric cord 18.

The fixture is designed for mounting on a spike or stake-type support indicated generally at 20. It includes a spike or stake 22 hinged by means of a pivot 23 to an adjustable horizontal bracket 24. The latter member of the mounting assembly has a central opening 26 by means of which the lamp holder is mounted on the support.

To achieve the purposes of the invention, the lamp holder 12 is encased in a tubular, weatherproof sheath indicated generally at 28. This member of the assembly is fabricated from a pliant, compressible, resiliently deformable material such as silicone rubber of suitable thickness. It fits snugly on the lamp holder and has an open outer end 30 and an open inner end 32.

Tubular sheath 28 has, in vertical section, a stepped configuration to provide an outer chamber 34 and an inner tubular segment 36. Chamber 34 is dimensioned to receive lamp holder 12 in snugly fitting, sealed relationship. Tubular segment 36 is dimensioned to receive cord 18, also in sealed, snugly fitting relation. It is dimensioned for insertion in opening 26 in bracket 24, thereby mounting the lamp holder on the bracket. A deformable, integral, annular rib 37 provides means for releasably retaining the lamp holder in position on the bracket.

Further to seal off the interior of lamp holder 12, there is provided at the upper end 30 of case 14, overlying the opening therein, an integral, inwardly directed flange 38. This is so dimensioned and positioned that when lamp 10 is screwed into socket 16, the chamfered shoulder 11 of the lamp squeezes against flange 38 and forms a tight seal.

Means also are provided further to seal off the inner end 32 of the sheath to prevent access of water to the interior of the lamp holder. The sealing means employed for this purpose comprise at least one, and preferably a spaced pair, of annular seal rings 40 in the bore of sheath tubular segment 36. These rings extend radially inwardly and bear against the cord 18 when the latter is inserted in the tubular segment, forming a tight seal.

Although the assembly thus described has utility in numerous applications, for certain applications, such as lawn illumination, it preferably is associated with shroud means enclosing lamp 10 and directing and coloring the illumination therefrom, as desired for particular purposes.

The shroud employed for this purpose is indicated generally at 42. Like lamp holder sheath 28 it is fabricated from a pliant, waterproof, resilient material such as silicone rubber, which is resistant to temperatures of the order of 230° F.

The shroud is outwardly flared to provide an open outer end 44 and an open inner end 46. The diameter of the latter is predetermined to make it possible for the shroud to telescope over the upper end of sheath 28 in sealed relationship, as illustrated in FIG. 1.

A liner 48 is mounted within shroud 42. It serves the dual functions of stabilizing the shroud and providing a reflective surface for directing light upwardly through the shroud outer end 44. Although it may be fabricated from a variety of structural materials, polished aluminum is a preferred material.

The open outer end of shroud 42 is provided with a lens 50 which serves two functions: that of sealing off the interior of the shroud, and that of transmitting the light to the area to be illuminated. As an optional third function, it may also color the light to achieve desired colored lighting effects such as red, green, blue or yellow. These functions are achieved by the provision of a glass or plastic lens 50 tinted in the desired color.

Mounting means are provided for mounting lens 50 across the open outer end of shroud 42.

In the illustrated form of the invention, the mounting means comprises a lens-mounting annular groove 52 in the inner margin of the shroud. This is dimensioned to receive lens 50 in sealed relationship.

Operation

The method of operation of our weatherproof electric lighting fixture is as follows:

Before or after mounting the fixture on stake 20, the stake is inserted in the ground in the desired geographic location. Lamp holder 12 is inserted in lamp holder sheath 28 with cord 18 extending through tubular lamp holder extension 36.

With lens 50 removed, shroud 42 is telescoped over the lamp holder.

Lamp 10 then is screwed into socket 16 until the chamfered shoulder 11 of the lamp bears against flange 38 of lamp holder sheath 28. This seals off the outer end of the lamp holder. The lower end is sealed off by the tight fit of tubular sheath extension 36 on cord 18, supplemented by the bearing pressure of resiliently compressible, annular rings 40.

When using shroud 42, a further seal is provided by the telescoping snug fit of shroud inner end 46 on sheath 28.

Still a further seal is furnished by the tightly fitting sealing engagement of lens 50 seated in annular groove 52 in sheath 28.

The assembled fastener then is easily mounted on spike support 20 by crowding sheath segment 36 into bracket opening 26, where it is retained releasably by flexible rib 37.

There thus is provided a simple, inexpensive, easily serviced, weatherproof electric lighting fixture which may be applied effectively to its various applications.

Having thus described in detail a preferred embodiment of the invention, it will be apparent to those skilled in the art that various physical changes may be made in the invention described without altering the inventive concepts and principles embodied. The present embodiment is therefore to be considered as illustrative and not restrictive, the scope of the invention being indicated by the appended claims.

We claim:

1. A weatherproof electric lighting fixture comprising:

a) electric lamp holder means (12) including an open end (16) adapted to receive an electric lamp (10) and an opposite end including an electric cord (18), b) a tubular lamp holder sheath (28) made of water resistant material, contoured and dimensioned to fit snugly around the lamp holder means in sealed relation thereto and having an open outer end (30) registering with the open end of the lamp holder means and an open inner end (32), c) the sheath having a stepped configuration providing an outer segment forming a chamber (34) of relatively large diameter for reception of the lamp holder means and a communicating tube segment (36) of relatively small diameter associated with said open inner end for reception of the electric cord, d) stake means (20) including a bracket (24) having a central opening (26) dimensioned for reception of the tube segment in snugly fitting frictional engagement, and e) a retaining flange (37) on the exterior of the tube segment positioned for engagement with the bracket and retention of the fixture mounted thereon.

2. A weatherproof electric lighting fixture comprising:

a) electric lamp holder means (12) including an electric socket (16) having an open end adapted to receive an electric lamp (10) and an opposite end including an electric cord (18), b) a tubular lamp holder sheath (28) made of water resistant, resiliently deformable material, contoured and dimensioned to fit snugly around the lamp holder means and electric cord (18) of the lamp holder means in sealed relation thereto and having an open outer end (30) registering with the open end of the lamp holder means and an open inner end (32), c) the sheath having a stepped configuration providing an outer segment forming a chamber (34) of relatively large diameter for reception of the lamp holder means and a communicating tube segment (36) of relatively small diameter associated with said open inner end for reception of the electric cord, and d) outwardly flared, tubular shroud means (42) of water resistant, resiliently deformable material having an open outer end (44) of enlarged diameter and an open inner end (46) of restricted diameter, the inner end being dimensioned and contoured for detachable telescopic mounting over the outer segment of the lamp holder sheath in sealed relationship thereto; a lens (5); and lens mounting means (52) disposed in a plane extending across the open outer end of the shroud means for mounting the lens across the open outer end of the shroud means in sealed relationship to the shroud means.

3. The lighting fixture of claim 2 wherein the lens has a peripheral margin and the lens mounting means comprises an annular groove (52) disposed in a plane extending across the open outer end of the shroud means and receiving the lens margin in frictional, sealing relationship.

* * * * *